US009901793B2

(12) United States Patent
Ban et al.

(10) Patent No.: US 9,901,793 B2
(45) Date of Patent: Feb. 27, 2018

(54) GOLF CLUB HEAD

(71) Applicant: BRIDGESTONE SPORTS CO., LTD., Tokyo (JP)

(72) Inventors: Wataru Ban, Chichibu (JP); Tomonori Kitagawa, Tokyo (JP); Kozue Wada, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/690,705

(22) Filed: Apr. 20, 2015

(65) Prior Publication Data

US 2015/0360099 A1 Dec. 17, 2015

(30) Foreign Application Priority Data

Jun. 13, 2014 (JP) ..... 2014-122722

(51) Int. Cl.
*A63B 53/06* (2015.01)
*A63B 53/04* (2015.01)

(52) U.S. Cl.
CPC ..... *A63B 53/06* (2013.01); *A63B 53/047* (2013.01); *A63B 53/0466* (2013.01); *A63B 2053/0433* (2013.01); *A63B 2053/0491* (2013.01)

(58) Field of Classification Search
CPC ..... A63B 53/06; A63B 53/0466
See application file for complete search history.

(56) References Cited

U.S. PATENT DOCUMENTS

| | | | | |
|---|---|---|---|---|
| 4,869,507 | A * | 9/1989 | Sahm | A63B 53/04 473/337 |
| 5,464,211 | A * | 11/1995 | Atkins, Sr. | A63B 53/04 473/346 |
| 6,558,271 | B1 | 5/2003 | Beach et al. | |
| 7,140,977 | B2 | 11/2006 | Atkins, Sr. | |
| 7,575,523 | B2 | 8/2009 | Yokota | |
| 7,588,502 | B2 * | 9/2009 | Nishino | A63B 53/0466 473/332 |
| 7,771,291 | B1 * | 8/2010 | Willett | A63B 53/0466 473/337 |
| 7,967,700 | B2 | 6/2011 | Stites | |
| 8,602,912 | B2 | 12/2013 | Stites | |
| 8,608,585 | B2 | 12/2013 | Stites et al. | |

FOREIGN PATENT DOCUMENTS

| | | | |
|---|---|---|---|
| JP | 4608426 | B2 | 1/2011 |
| JP | 4608437 | B2 | 1/2011 |
| JP | 2012-525214 | A | 10/2012 |
| JP | 5438124 | B2 | 3/2014 |

* cited by examiner

*Primary Examiner* — Gene Kim
*Assistant Examiner* — Jeffrey Vanderveen
(74) *Attorney, Agent, or Firm* — Sughrue Mion, PLLC

(57) ABSTRACT

A golf club head of this invention includes a face portion, first and second interchangeable members, a first attachment portion from which the first and second interchangeable members are detachable, and a second attachment portion from which the first and second interchangeable members are detachable. The first interchangeable member is a reinforcing member that abuts against the rear surface of the face portion and restricts deformation of an abutment portion when the member is attached to the first attachment portion. The second interchangeable member is a member that does not abut against the rear surface of the face portion when the member is attached to the first attachment portion.

11 Claims, 4 Drawing Sheets

GOLF CLUB HEAD

BACKGROUND OF THE INVENTION

Field of the Invention

The present invention relates to a golf club head.

Description of the Related Art

To improve the performance of a golf club head, various structures have been proposed. For example, U.S. Pat. No. 6,558,271 discloses a golf club head that has a hollow structure incorporating a skeleton so as to improve the degree of freedom for the position of center of gravity and the like. For example, each of U.S. Pat. Nos. 7,140,977 and 8,602,912 and Japanese Patent No. 5438124 discloses a golf club head having a structure that reinforces the central portion of the face portion. Each of Japanese Patent Nos. 4608437 and 4608426 discloses a golf club head that includes an interchangeable part so as to allow a user to select desired characteristics. Each of Japanese Patent Nos. 4608437 and 4608426 discloses an interchangeable part that promotes attenuation of vibration in the face portion at impact. Japanese Patent Laid-Open No. 2012-525214 discloses a golf club head having a structure that reinforces the central portion of the face portion, and particularly, a structure capable of adjusting the rigidity of the central portion.

The rigidity distribution of the face portion affects characteristics of a golf club head such as distance performance and a hitting feel. However, the degree of effects changes depending on the capability and need of a golfer. Hence, it is preferable to allow the golfer to select desired characteristics.

SUMMARY OF THE INVENTION

It is an object of the present invention to provide a golf club head that allows a golfer to change the rigidity distribution of a face portion.

According to an aspect of the present invention, there is provided a golf club head comprising: a face portion; a plurality of interchangeable members; and a plurality of attachment portions, wherein the plurality of interchangeable members include at least a first interchangeable member, and a second interchangeable member, the plurality of attachment portions include at least a first attachment portion from which the first interchangeable member is detachable, and a second attachment portion disposed at a portion different from the first attachment portion, from which the second interchangeable member is detachable, the first interchangeable member is detachable from the second attachment portion, the second interchangeable member is detachable from the first attachment portion, the first interchangeable member is a reinforcing member that abuts against a rear surface of the face portion and restricts deformation of an abutment portion when the first interchangeable member is attached to the first attachment portion, and the second interchangeable member is a member that does not abut against the rear surface of the face portion when the second interchangeable member is attached to the first attachment portion.

Further features of the present invention will become apparent from the following description of exemplary embodiments (with reference to the attached drawings).

DESCRIPTION OF THE EMBODIMENTS

First Embodiment

Figure 1A:
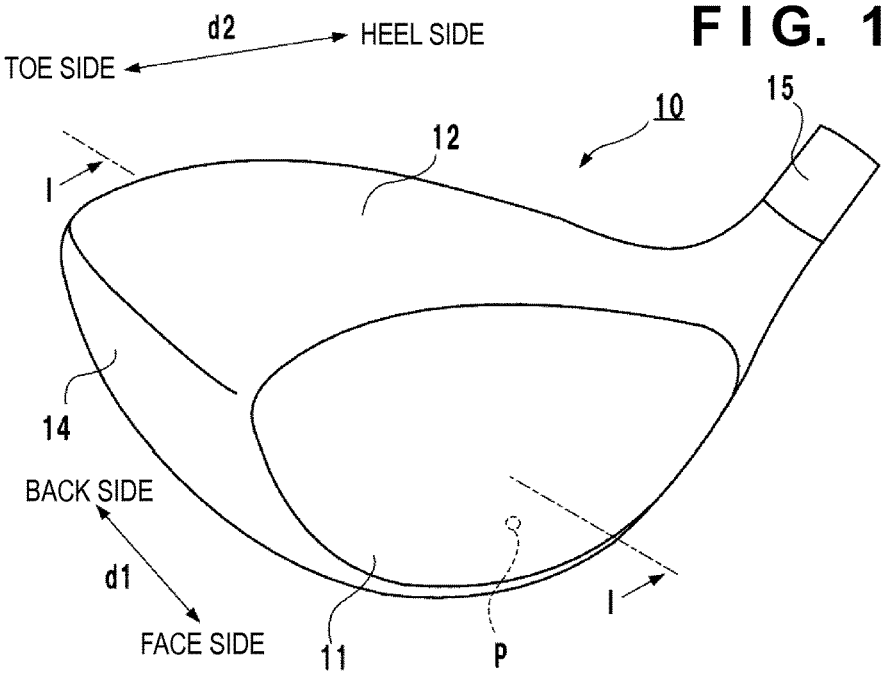
FIG. 1A is a perspective view of a golf club head according to an embodiment of the present invention.
Figure 1B:
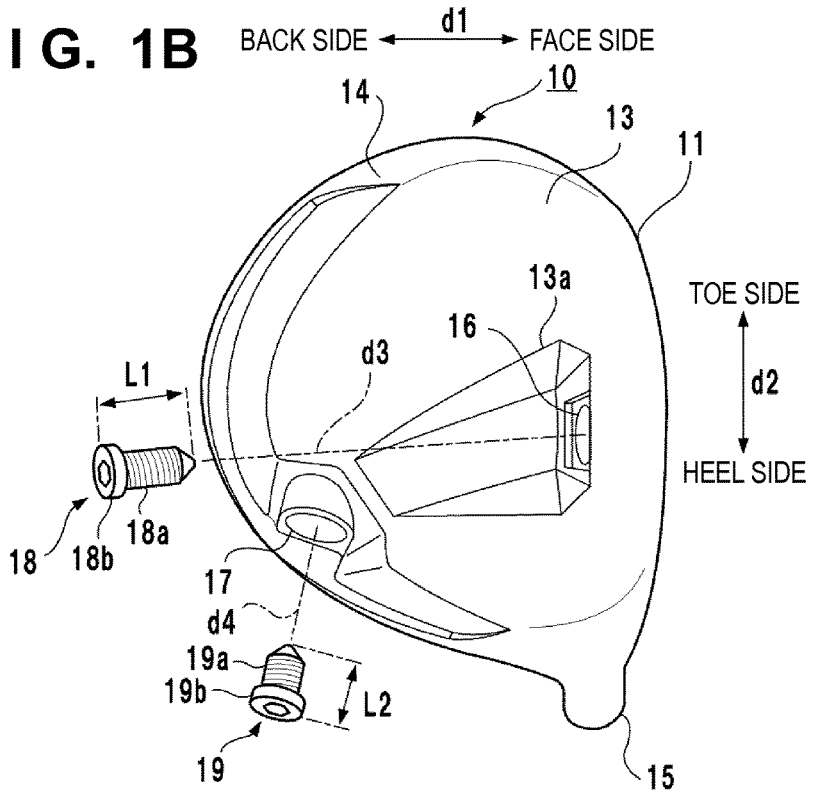
FIG. 1B is a view of the golf club head shown in FIG. 1A which is viewed from the side of a sole portion.

FIG. 1A is a perspective view of a golf club head 10 according to an embodiment of the present invention. FIG. 1B is a view of the golf club head 10 viewed from the side of a sole portion 13.

The golf club head 10 is hollow and has peripheral walls formed from a face portion 11, a crown portion 12, the sole portion 13, and a side portion 14. The surface (front surface) of the face portion 11 forms a face (striking face). A bulge and a roll can be formed on the face. The crown portion 12 forms the upper portion of the golf club head 10. The sole portion 13 forms the bottom portion of the golf club head 10. The side portion 14 forms the portion between the sole portion 13 and the crown portion 12. The golf club head 10 includes a hosel portion 15 to which a shaft is attached.

An arrow d1 in FIG. 1A indicates the face-back direction, and an arrow d2 indicates the toe-heel direction. The face-back direction normally corresponds to a target line direction (target direction of a shot). The toe-heel direction is the direction in which the toe-side end and the heel-side end of the sole portion 13 are connected. The vertical direction of the face portion 11 is defined based on the golf club head grounded in accordance with a predetermined lie angle. In this embodiment, the vertical direction is the direction of sole portion 13-crown portion 12.

The golf club head 10 is a golf club head for a driver. However, the present invention is applicable to golf club heads of other types such as wood type golf club heads including a fairway wood other than drivers.

The golf club head 10 can be made of a metal material. Examples of the metal material are a titanium-based metal (for example, titanium alloy 6Al—4V—Ti), stainless steel, and a copper alloy such as beryllium copper.

The golf club head 10 can be assembled by joining a plurality of parts. For example, the golf club head 10 can be formed from a main body member and a face member. The main body member forms the peripheral portions including the crown portion 12, the sole portion 13, the side portion 14, and the face portion 11. An opening is formed at part of the portion corresponding to the face portion 11. The face member is joined to the opening of the main body member.

The golf club head 10 includes attachment portions 16 and 17. In this embodiment, the attachment portion 16 is disposed in the sole portion 13. More specifically, the sole portion 13 includes a concave portion 13*a* that is recessed with respect to the periphery, and the attachment portion 16 is formed in the wall portion of the concave portion 13*a* and located inside the golf club head 10. In addition, the attachment portion 16 is located at the central portion of the sole portion 13 concerning the direction d2, and disposed at a position close to the side of the face portion 11 concerning the direction d1.

The attachment portion 17 is disposed at a position different from the attachment portion 16. In this embodiment, the attachment portion 17 is disposed in the side portion 14 on the back side, and disposed at a position close to the back side concerning the direction d1. For this reason, the attachment portions 16 and 17 are disposed at portions spaced apart from each other in the direction d1. The attachment portion 17 is disposed at a position close to the heel side concerning the direction d2. For this reason, the attachment portions 16 and 17 are disposed at portions spaced apart from each other in the direction d2 as well.

In the embodiment, the attachment portions 16 and 17 are threaded holes having the same diameter and same pitch. The attachment portion 16 is formed such that a center line d3 crosses the face portion 11. The attachment portion 17 is formed such that a center line d4 is closer to the direction d2 than the direction d1.

The golf club head 10 includes interchangeable members 18 and 19. In this embodiment, the interchangeable member 18 is a screw member integrally including a screw shaft 18*a* and a head portion 18*b*. In this embodiment, the interchangeable member 19 is a screw member integrally including a screw shaft 19*a* and a head portion 19*b*.

Each of the head portions 18*b* and 19*b* has a hole that has a closed bottom and engages with a tool such as a hexagonal wrench. Each of the screw shafts 18*a* and 19*a* has a shaft diameter and a screw thread pitch to threadably engage with the attachment portions 16 and 17. Hence, the interchangeable member 18 can freely selectively be detached from either of the attachment portions 16 and 17. Similarly, the interchangeable member 19 can freely selectively be detached from either of the attachment portions 16 and 17. As described above, although the attachment portion 16 is located inside the golf club head 10, the concave portion 13*a* makes it relatively easy to detach the interchangeable member 18 or 19. The attachment portion 17 opens to the side portion 14. This also makes it relatively easy to detach the interchangeable member 18 or 19.

In this embodiment, the interchangeable members 18 and 19 have the same structure except the total length. The total length of the interchangeable member 18 is L1, and the total length of the interchangeable member 19 is L2, which hold a relationship given by L1>L2. In this embodiment, the difference between the total lengths L1 and L2 is mainly caused by the length difference between the screw shafts 18*a* and 19*a*. The head portions 18*b* and 19*b* have the same shape.

In this embodiment, the interchangeable members 18 and 19 are solid metal members integrally made of metal materials having the same specific gravity. Examples of the metal material are titanium, titanium alloy, aluminum, aluminum alloy, tungsten, tungsten alloy, and stainless steel. As already described, the interchangeable members 18 and 19 have different total lengths and therefore have different weights. In this embodiment, the interchangeable member 18 is longer and therefore heavier than the interchangeable member 19.

In the golf club head 10 according to this embodiment, the attachment positions of the interchangeable members 18 and 19 can be selected. In the first attachment mode, the interchangeable member 18 is attached to the attachment portion 16, and the interchangeable member 19 is attached to the attachment portion 17. In the second attachment mode, the interchangeable member 18 is attached to the attachment portion 17, and the interchangeable member 19 is attached to the attachment portion 16.

Figure 2A:
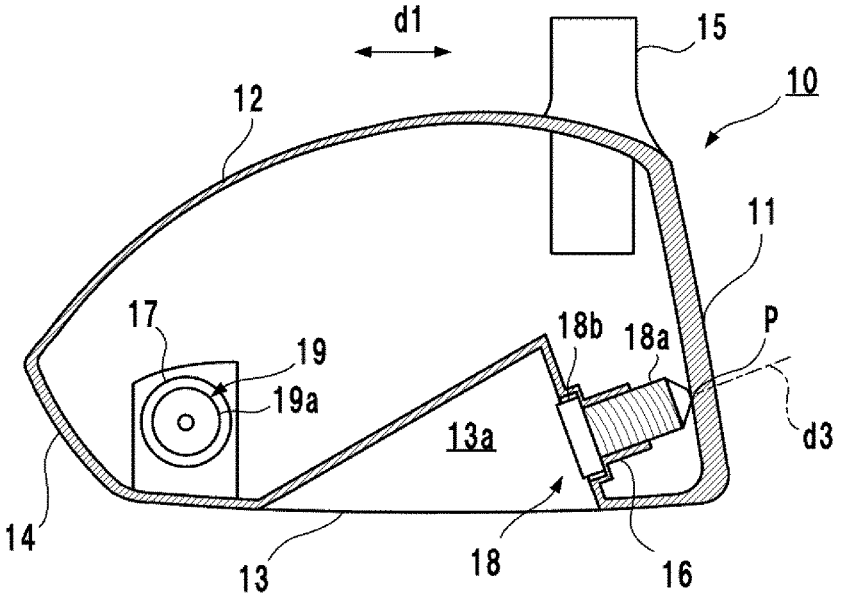
FIGS. 2A and 2B are sectional views taken along a line I-I in FIG. 1A.
Figure 2B:
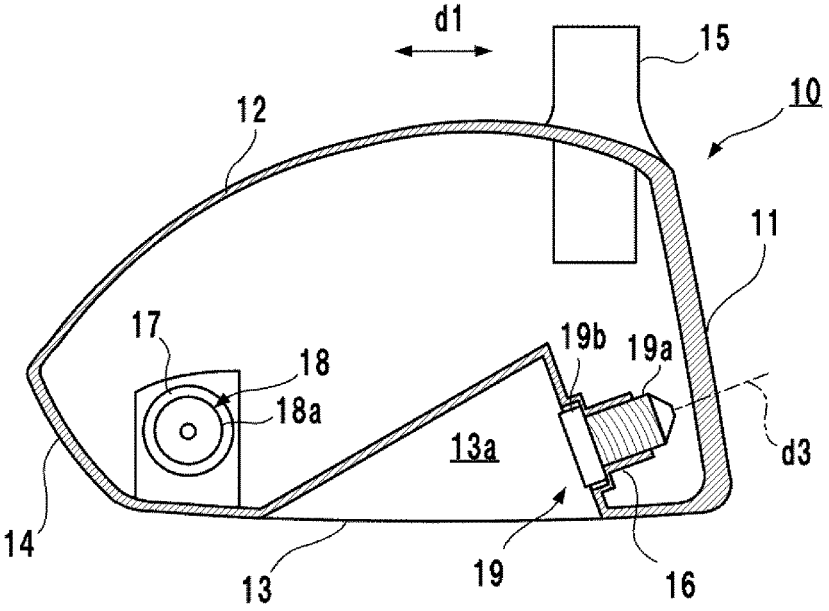

The difference between the attachment modes will be described below with reference to FIGS. 2A and 2B. FIGS. 2A and 2B are sectional views taken along a line I-I in FIG. 1A. FIG. 2A is a sectional view in the first attachment mode. FIG. 2B is a sectional view in the second attachment mode.

As shown in FIG. 2A, in the first attachment mode, the distal end of the interchangeable member 18 (the distal end of the screw shaft 18*a*) abuts against the rear surface of the face portion 11. In other words, the total length L1 of the interchangeable member 18 (particularly the length of the screw shaft 18*a*) and the position of the attachment portion 16 are designed such that the distal end of the interchangeable member 18 abuts against the rear surface of the face portion 11.

When the distal end of the screw shaft 18*a* abuts against the rear surface of the face portion 11, deformation of the face portion 11 at an abutment portion P is restricted. That is, the interchangeable member 18 functions as a reinforcing member that locally restricts deformation of the face portion 11. In this embodiment, the distal end of the screw shaft 18*a* is tapered and comes into point contact with the rear surface of the face portion 11. This can suppress excessive restriction on deformation of the face portion 11. The distal end of the screw shaft 18*a* may be in contact so as not to press the rear surface of the face portion 11 or so as to press the rear surface to the face side in the natural state. The degree of pressing may be adjustable by the degree of fastening of the screw shaft 18*a* in the attachment portion 16. In the maximum fastening level, the distal end of the screw shaft 18*a* may slightly displace the rear surface of the face portion 11 to the face side.

In this embodiment, the abutment portion P is located at the central portion of the face portion 11 concerning the direction d2 or on the lower side of the face portion 11 concerning the vertical direction. An example of the position of the abutment portion P will be described in detail with reference to FIGS. 3A and 3B.

Figure 3A:
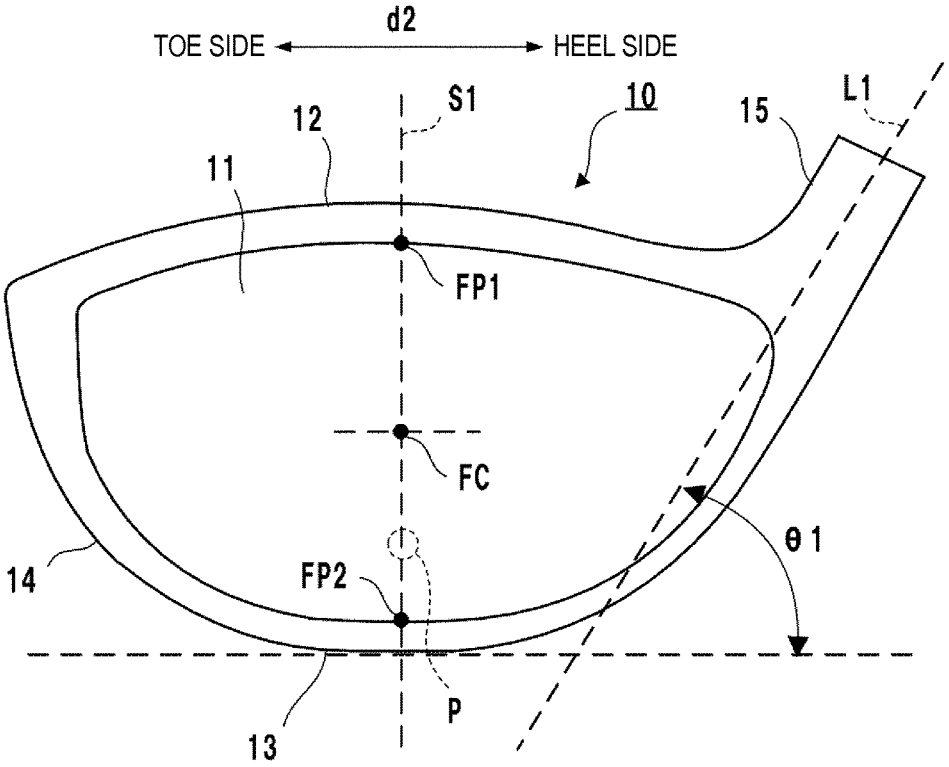
FIGS. 3A and 3B are explanatory views of an example of the position of an abutment portion.
Figure 3B:
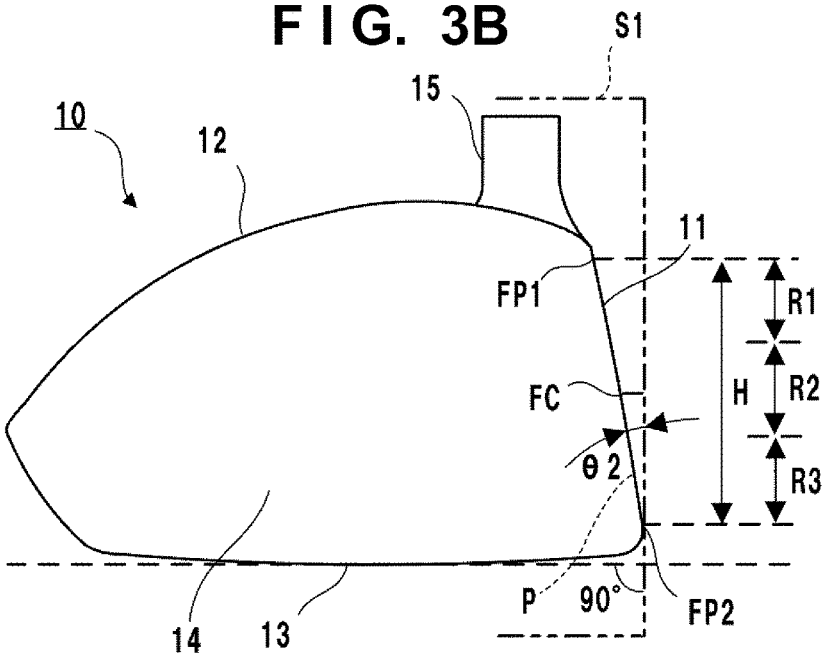

Referring to FIG. 3A, a plane S1 is a virtual vertical plane that passes through a geometric center Fc of the face portion 11 and is perpendicular to the ground surface and the toe-heel direction when the golf club head 10 is grounded at a predetermined lie angle and a predetermined loft angle. Note that the lie angle is made by the ground surface and an axis L11 of a shaft mounted on the hosel portion 15, as indicated by an angle θ1 in FIG. 3A. The loft angle is made by the face portion 11 and a plane perpendicular to the ground surface, as indicated by an angle θ2 in FIG. 3B.

Let FP1 and FP2 be the upper and lower end positions of the face portion 11 crossing the plane S1, respectively. A height difference H between the positions FP1 and FP2 is defined as the height of the face portion 11.

The face portion 11 is virtually divided into three areas R1 to R3 in accordance with the height. The lower area R3 is, for example, an area of H×0.3 from the lower end of the face portion 11. The central area R2 is, for example, an area of H×0.7 from the upper end of the lower area R3. The upper area R1 is, for example, an area from the upper end of the central area R2 to the upper end of the face portion 11. They are expressed by numerical values as lower area R3≤H×0.3, H×0.3<central area R2≤H×0.7, and upper area R1>H×0.7. The abutment portion P can be set in the lower area R3.

Referring to FIG. 2B, in the second attachment mode, the distal end of the interchangeable member 19 (the distal end of the screw shaft 19*a*) does not abut against the rear surface of the face portion 11. In other words, the total length L2 of the interchangeable member 19 (particularly the length of the screw shaft 19*a*) and the position of the attachment portion 16 are designed such that the distal end of the interchangeable member 19 is spaced apart from the rear surface of the face portion 11 so as not to abut against the rear surface. In this embodiment, the presence/absence of abutment against the rear surface of the face portion 11 is controlled by the total lengths of the interchangeable members 18 and 19, and the presence/absence of abutment against the rear surface of the face portion 11 can be switched by a relatively simple structure.

A change in the characteristics of the golf club head 10 between the first attachment mode and the second attachment mode will be explained. In this embodiment, two types of characteristics simultaneously change between the two attachment modes. One of the characteristics is the rigidity distribution of the face portion 11, and the remaining one is the position of center of gravity.

In the first attachment mode, deformation of the abutment portion P is restricted. As for the rigidity distribution of the face portion 11, the rigidity is relatively low from the central portion to the upper portion and relatively high at the lower portion. That is, at impact, since the upper portion of the face portion 11 readily flexes to the back side, the launch angle of the shot tends to be high. Focusing on the center of gravity, the attachment portions 16 and 17 are spaced part from each other in the direction d1, and the interchangeable member 18 is heavier than the interchangeable member 19. Hence, the position of center of gravity of the golf club head 10 is located relatively on the side of the face portion 11. Hence, the back spin rate of the shot tends to be suppressed. For the above-described reasons, the maximum distance performance of a shot becomes relatively high in the first attachment mode.

In the second attachment mode, deformation of the face portion 11 is not restricted by the interchangeable members 18 and 19. Hence, as for the rigidity distribution of the face portion 11, the rigidity is not relatively high at the lower portion, unlike the first attachment mode. That is, the area having a high repulsion is wider than in the first attachment mode. Focusing on the center of gravity, the attachment portions 16 and 17 are spaced part from each other in the direction d1, and the interchangeable member 18 that is relatively heavy is located on the back side. Hence, the gravity depth is deeper, and the moment of inertia of the golf club head 10 is larger than in the first attachment mode. For the above-described reasons, in the second attachment mode, the variation in the distance of a shot with respect to the variation in the impact point becomes relatively small.

As described above, in this embodiment, a golfer can change the rigidity distribution or the position of center of gravity of the face portion 11 by changing the combinations of the interchangeable members 18 and 19 and the attachment portions 16 and 17. The rigidity distribution and the position of center of gravity are not changed irrelevantly. That is, in the first attachment mode, a rigidity distribution and a position of center of gravity which are suitable for improving the maximum distance performance are obtained. In the second attachment mode, a rigidity distribution and a position of center of gravity which are suitable for suppressing a variation in the distance performance are obtained. Hence, the golfer can easily understand the difference in the characteristics of the golf club head 10 caused by the difference in the attachment position.

Second Embodiment

Figure 4A:
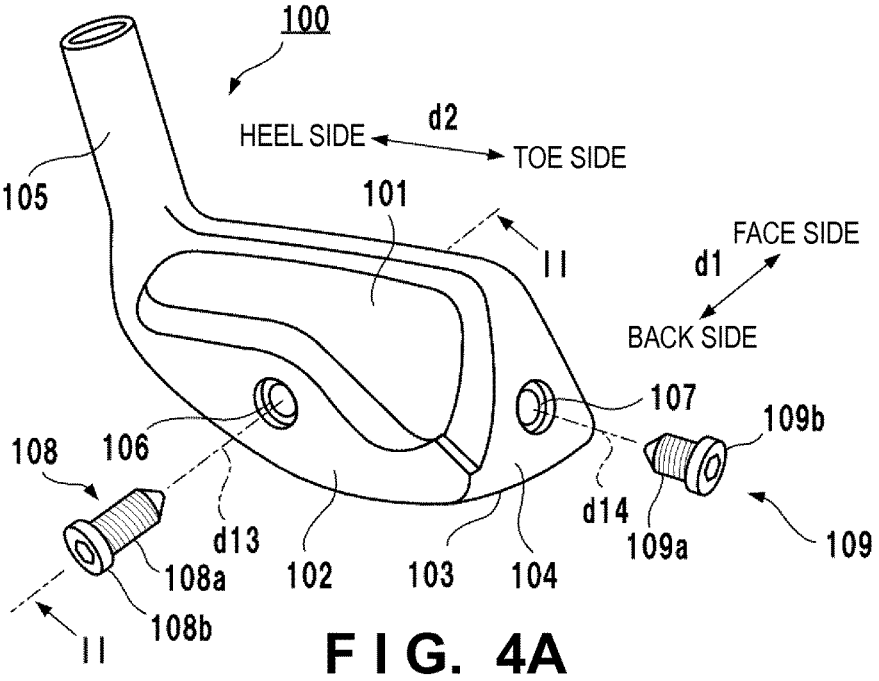
FIGS. 4A to 4C are explanatory views of other examples.

The present invention is also applicable to an iron type golf club head. FIG. 4A is a perspective view of a golf club head 100 according to another embodiment of the present invention. Arrows d1 and d2 indicate the face-back direction and the toe-heel direction, respectively, as in the first embodiment.

The golf club head 100 includes a face portion 101, a back portion 102, a sole portion 103, a side portion 104, and a hosel portion 105.

The surface (front surface) of the face portion 101 forms a face (striking face). Score lines can be formed in the face. The back portion 102 is spaced apart from the face portion 101 in the direction d1 (face-back direction) and forms the rear portion of the golf club head 100. The sole portion 103 forms the bottom portion of the golf club head 100 and connects the face portion 101 and the back portion 102. The side portion 104 forms the side portion of the golf club head 100.

The golf club head 100 can be formed from a single part or assembled by joining a plurality of parts. When joining a plurality of parts, for example, the golf club head 100 can be formed from a main body member and a face member. The main body member forms portions other than the face portion 101, and the face member is joined to the main body member to form the face portion 101.

The golf club head 100 includes attachment portions 106 and 107. In this embodiment, the attachment portion 106 is disposed in the back portion 102. More specifically, the attachment portion 106 is located at the central portion of the back portion 102 concerning the direction d2, and located at the central portion of the back portion 102 concerning the vertical direction.

The attachment portion 107 is disposed at a position different from the attachment portion 106. In this embodiment, the attachment portion 107 is disposed in the side portion 104 on the toe side. For this reason, the attachment portions 106 and 107 are disposed at portions spaced apart from each other in the direction d2. The attachment portion 107 is located between the face portion 101 and the back portion 102 concerning the direction d1. For this reason, the attachment portions 106 and 107 are disposed at portions spaced apart from each other in the direction d1 as well.

In the embodiment, the attachment portions 106 and 107 are threaded holes having the same diameter and same pitch. The attachment portion 106 is formed such that a center line d13 crosses the face portion 101. The attachment portion 107 is formed such that a center line d14 is closer to the direction d2 than the direction d1. In this embodiment, the center line d14 is parallel to the direction d2.

The golf club head 100 includes interchangeable members 108 and 109. In this embodiment, the interchangeable member 108 is a screw member integrally including a screw shaft 108*a* and a head portion 108*b*. In this embodiment, the interchangeable member 109 is a screw member integrally including a screw shaft 109*a* and a head portion 109*b*.

Each of the head portions 108*b* and 109*b* has a hole that has a closed bottom and engages with a tool such as a hexagonal wrench. Each of the screw shafts 108*a* and 109*a* has a shaft diameter and a screw thread pitch to threadably engage with the attachment portions 106 and 107. Hence, the interchangeable member 108 can freely selectively be detached from either of the attachment portions 106 and 107. Similarly, the interchangeable member 109 can freely selectively be detached from either of the attachment portions 106 and 107. The attachment portions 106 and 107 open to the back portion 102 and the side portion 104, respectively. This also makes it relatively easy to detach the interchangeable member 108 or 109.

In this embodiment, the interchangeable members 108 and 109 have the same structure except the total length, and the total length of the interchangeable member 108 is longer, like the interchangeable members 18 and 19 according to the first embodiment. The interchangeable members 108 and 109 are solid metal members integrally made of metal materials having the same specific gravity.

In the golf club head 100 according to this embodiment, the attachment positions of the interchangeable members 108 and 109 can be selected. In the first attachment mode, the interchangeable member 108 is attached to the attachment portion 106, and the interchangeable member 109 is attached to the attachment portion 107. In the second attachment mode, the interchangeable member 108 is attached to the attachment portion 107, and the interchangeable member 109 is attached to the attachment portion 106.

Figure 4B:
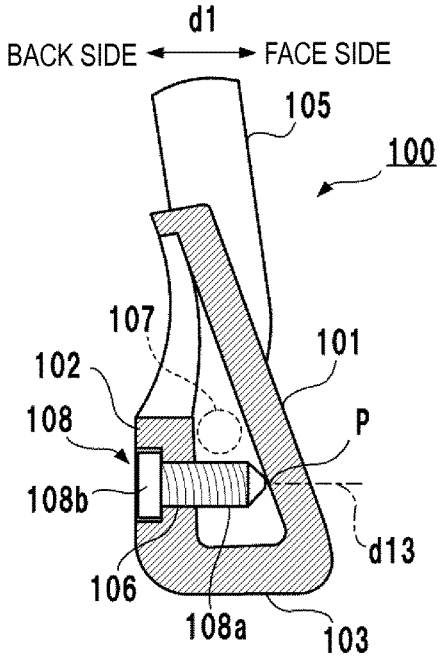
Figure 4C:
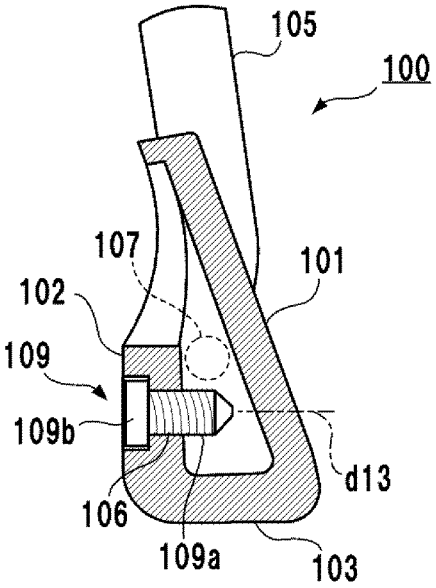

The difference between the attachment modes will be described below with reference to FIGS. 4B and 4C. FIGS. 4B and 4C are sectional views taken along a line II-II in FIG. 4A. FIG. 4B is a sectional view in the first attachment mode. FIG. 4C is a sectional view in the second attachment mode.

As shown in FIG. 4B, in the first attachment mode, the distal end of the interchangeable member 108 (the distal end of the screw shaft 108*a*) abuts against the rear surface of the face portion 101. When the distal end of the screw shaft 108*a* abuts against the rear surface of the face portion 101, deformation of the face portion 101 at an abutment portion P is restricted. That is, the interchangeable member 108 functions as a reinforcing member that locally restricts deformation of the face portion 101. In this embodiment, the distal end of the screw shaft 108*a* is tapered and comes into point contact with the rear surface of the face portion 101. This can suppress excessive restriction on deformation of the face portion 101. The distal end of the screw shaft 108*a* may be in contact so as not to press the rear surface of the face portion 101 or so as to press the rear surface to the face side in the natural state. The degree of pressing may be adjustable by the degree of fastening of the screw shaft 108*a* in the attachment portion 106. In the maximum fastening level, the distal end of the screw shaft 108*a* may slightly displace the rear surface of the face portion 101 to the face side.

In this embodiment, the abutment portion P is located at the central portion of the face portion 101 concerning the direction d2 or on the lower side of the face portion 101 concerning the vertical direction. As for an example of the position of the abutment portion P, the abutment portion P may be located in a lower area R3 described above with reference to FIGS. 3A and 3B.

Referring to FIG. 4C, in the second attachment mode, the distal end of the interchangeable member 109 does not abut against the rear surface of the face portion 101.

A change in the characteristics of the golf club head 100 between the first attachment mode and the second attachment mode will be explained. In this embodiment, two types of characteristics simultaneously change between the two attachment modes. One of the characteristics is the rigidity distribution of the face portion 101, and the remaining one is the position of center of gravity.

In the first attachment mode, deformation of the abutment portion P is restricted. As for the rigidity distribution of the face portion 101, the rigidity is relatively low from the central portion to the upper portion and relatively high at the lower portion. In the iron type golf club head, generally, the impact point exists from the central portion to the lower portion of the face. That is, since the lower portion of the face portion 101 hardly flexes at impact, the hitting feel is good. Focusing on the center of gravity, the attachment portions 106 and 107 are spaced part from each other in the direction d2, and the interchangeable member 108 is heavier than the interchangeable member 109. Hence, the position of center of gravity of the golf club head 100 is located relatively on the side of the hosel portion 105. Hence, the golf club head 100 readily rotates about the shaft axis, and the operability improves.

In the second attachment mode, deformation of the face portion 101 is not restricted by the interchangeable members 108 and 109. Hence, as for the rigidity distribution of the face portion 101, the rigidity is not relatively high at the lower portion, unlike the first attachment mode. That is, the area having a high repulsion is wider than in the first attachment mode. Focusing on the center of gravity, the attachment portions 106 and 107 are spaced part from each other in the direction d2, and the interchangeable member 108 that is relatively heavy is located on the toe side. Hence, the moment of inertia of the golf club head 100 is larger than in the first attachment mode. For the above-described reasons, in the second attachment mode, the variation in the distance of a shot with respect to the variation in the impact point becomes relatively small.

As described above, in this embodiment, a golfer can change the rigidity distribution or the position of center of gravity of the face portion 101 by changing the combinations of the interchangeable members 108 and 109 and the attachment portions 106 and 107. The rigidity distribution and the position of center of gravity are not changed irrelevantly. That is, in the first attachment mode, a rigidity distribution and a position of center of gravity which are suitable for the need of an advanced player, for example, a hitting feel and operability are obtained. In the second attachment mode, a rigidity distribution and a position of center of gravity which are suitable for a beginner, for example, suppressing a variation in the distance are obtained. Hence, the golfer can easily understand the difference in the characteristics of the golf club head 100 caused by the difference in the attachment position.

Other Embodiments

In the first embodiment, a screw structure is employed as a structure to freely detach the interchangeable members 18 and 19 from the attachment portions 16 and 17. However, the present invention is not limited to this, and any other detachment structure may be employed. The structure and shape of the interchangeable members 18 and 19 are not limited to those described above. This also applies to the second embodiment.

In the first embodiment, the interchangeable members 18 and 19 have different weights. However, they may have the same weight. In this arrangement, however, the change in the center of gravity between the first attachment mode and the second attachment mode may be absent or very small, and only the rigidity distribution of the face portion 11 changes substantially. This also applies to the second embodiment.

In the first embodiment, the interchangeable members 18 and 19 are solid metal members. However, they may be hollow metal members. When hollow metal members are used, for example, the screw shafts 18*a* and 19*a* may have a cylindrical shape. This also applies to the second embodiment.

In the first embodiment, the interchangeable members 18 and 19 are metal members having the same specific gravity. However, they may be metal members having different specific gravities. In addition, the interchangeable members 18 and 19 may be made of materials other than metal materials. However, the interchangeable member 18 is preferably made of a material having a high rigidity because it restricts deformation of the face portion 11. This also applies to the second embodiment.

In the first embodiment, the abutment portion P is located on the lower portion at the central portion of the face portion 11. However, the present invention is not limited to this, and the position of the abutment portion P can be set in accordance with the range of a target sweet area. This also applies to the second embodiment.

In the first embodiment, the number of interchangeable members is two. However, the number of interchangeable members may be three or more. The number of attachment portions may also be three or more. In this case, each interchangeable member can freely be detached from any attachment portion. The positions of the attachment portions are not limited to those described above. This also applies to the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-122722, filed Jun. 13, 2014, which is hereby incorporated by reference herein in its entirety.

What is claimed is:

1. A wood type golf club head comprising:

a crown portion;

a sole portion;

a side portion;

a face portion;

a plurality of interchangeable members; and a plurality of attachment portions, wherein said plurality of interchangeable members include at least a first interchangeable member, and a second interchangeable member, said plurality of attachment portions include at least a first attachment portion from which said first interchangeable member is detachable, and a second attachment portion disposed at a portion different from said first attachment portion, from which said second interchangeable member is detachable, said first interchangeable member is detachable from said second attachment portion, said second interchangeable member is detachable from said first attachment portion, said first attachment portion is disposed in said sole portion, said second attachment portion is disposed in said side portion on a back side, said second attachment portion is disposed at a portion spaced apart from said first attachment portion at least in a face-back direction and in a toe-heel direction, said first interchangeable member is heavier than said second interchangeable member, said first interchangeable member is a reinforcing member that abuts against only a lower portion in a rear surface of said face portion and restricts deformation of the lower portion when said first interchangeable member is attached to said first attachment portion, said first interchangeable member does not abut against the rear surface of said face portion when said first interchangeable member is attached to said second attachment portion, said second interchangeable member is a member that does not abut against the rear surface of said face portion when said second interchangeable member is attached to said first attachment portion, said second interchangeable member does not abut against the rear surface of said face portion when said second interchangeable member is attached to said second attachment portion, in a first attachment mode, said first interchangeable member is attached to said first attachment portion and said second interchangeable member is attached to said second attachment portion, in a second attachment mode, said first interchangeable member is attached to said second attachment portion and said second interchangeable member is attached to said first attachment portion, in the second attachment mode:

an area having a high repulsion in said face portion is wider than in the first attachment mode;

a gravity depth of the head is deeper than in the first attachment mode; and a moment of inertia of the head is larger than in the first attachment mode.

2. The wood type golf club head according to claim 1, wherein said first interchangeable member and said second interchangeable member have total lengths that are different from each other.

3. The wood type golf club head according to claim 1, wherein the lower portion is a central portion in the toe-heel direction.

4. The wood type golf club head according to claim 1, wherein each of said first interchangeable member and said second interchangeable member comprises a screw shaft, and each of said first attachment portion and said second attachment portion comprises a threaded hole that threadably engages with said screw shaft.

5. The wood type golf club head according to claim 4, wherein said sole portion includes a concave portion, said concave portion includes a wall portion located at a central portion in the toe-heel direction and at a side of said face portion in the face-back direction, and said first attachment portion is formed in the wall portion.

6. The wood type golf club head according to claim 4, wherein said threaded hole of said first attachment portion is formed so as to make a center line cross said face portion.

7. The wood type golf club head according to claim 4, wherein said screw shaft of said first interchangeable member comprises one of a solid metal member or a hollow metal member.

8. The wood type golf club head according to claim 1, wherein said plurality of interchangeable members include at least three interchangeable members.

9. The wood type golf club head according to claim 1, wherein said plurality of attachment portions include at least three attachment portions.

10. The wood type golf club head according to claim 1, wherein said face portion has a height H, and the lower portion is positioned within an area of H×0.3 from a lower end of said face portion.

11. The wood type golf club head according to claim 1, wherein said plurality of attachment portions includes only said first and second attachment portions.

* * * * *